US009523306B2

(12) United States Patent
Dickerson

(10) Patent No.: US 9,523,306 B2
(45) Date of Patent: Dec. 20, 2016

(54) ENGINE COOLING FAN CONTROL STRATEGY

(71) Applicant: International Engine Intellectual Property Company, LLC, Lisle, IL (US)

(72) Inventor: Steven Joseph Dickerson, Lake in the Hills, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 193 days.

(21) Appl. No.: 14/276,114

(22) Filed: May 13, 2014

(65) Prior Publication Data

US 2015/0330287 A1 Nov. 19, 2015

(51) Int. Cl.

*F01P 7/02* (2006.01)
*F01P 7/08* (2006.01)
*F01P 5/04* (2006.01)

(52) U.S. Cl.

CPC .. *F01P 7/08* (2013.01); *F01P 5/04* (2013.01); *F01P 2025/30* (2013.01); *F01P 2025/40* (2013.01)

(58) Field of Classification Search

CPC ..... F01P 7/165; F01P 2025/30; F01P 2060/04; F01P 7/026; F01P 2025/40; F01P 2025/60; F01P 3/00; F01P 7/12; F01P 7/16

See application file for complete search history.

(56) References Cited

U.S. PATENT DOCUMENTS 4,489,680 A * 12/1984 Spokas ..... F01P 7/048 123/41.05
4,546,742 A * 10/1985 Sturges ..... B60H 1/00764 123/41.05
4,665,319 A * 5/1987 Seepe ..... F01P 7/048 290/1 B
4,930,460 A * 6/1990 Aihara ..... B60K 11/00 123/41.31
4,977,743 A * 12/1990 Aihara ..... F01P 7/048 123/41.31
5,215,044 A * 6/1993 Banzhaf ..... F01P 7/026 123/41.05

(Continued)

FOREIGN PATENT DOCUMENTS

JP EP 1870576 A1 * 12/2007 ..... F01P 7/044

*Primary Examiner* — Marguerite McMahon
*Assistant Examiner* — Tea Holbrook
(74) *Attorney, Agent, or Firm* — Jack D. Nimz; Jeffrey P. Calfa

(57) ABSTRACT

An engine cooling fan control strategy includes measuring an engine coolant temperature using a sensor connected to the engine, measuring an engine oil temperature using a sensor connected to the engine, selecting a first value from a maximum engine coolant temperature threshold calibration curve stored in the control system based on the engine oil temperature, selecting a second value from a minimum engine coolant temperature threshold calibration curve stored in the control system based on the engine oil temperature, and placing the engine cooling fan in driven relationship with the engine when the engine coolant temperature exceeds the first value, and placing the engine cooling fan in non-driven relationship with the engine when the engine coolant temperature drops below the second value.

5 Claims, 3 Drawing Sheets

(56) References Cited

U.S. PATENT DOCUMENTS 5,415,147 A * 5/1995 Nagle ..... F01P 3/20 123/41.29
5,445,128 A * 8/1995 Letang ..... B60K 31/045 123/436
5,477,827 A * 12/1995 Weisman, II ..... B60K 31/04 123/436
5,507,251 A * 4/1996 Hollis ..... F01P 7/167 123/41.1
5,598,705 A * 2/1997 Uzkan ..... F01P 7/165 60/599
5,619,957 A * 4/1997 Michels ..... F01P 7/048 123/41.12
5,657,722 A * 8/1997 Hollis ..... F01P 7/167 123/41.08
5,669,335 A * 9/1997 Hollis ..... F01P 7/167 123/196 AB
5,724,924 A * 3/1998 Michels ..... F01P 7/044 123/41.12
5,787,711 A * 8/1998 Woollenweber ..... F01D 15/10 123/41.12
6,055,946 A 5/2000 Dombek
6,067,489 A * 5/2000 Letang ..... F01P 7/04 123/299
6,076,488 A * 6/2000 Yamagishi ..... F01P 5/043 123/41.12
6,079,536 A * 6/2000 Hummel ..... F01P 7/026 192/103 R
6,178,928 B1 * 1/2001 Corriveau ..... F01P 7/048 123/41.12
6,202,014 B1 * 3/2001 Brandt ..... E02F 3/3414 172/12
6,308,664 B1 * 10/2001 Ambros ..... F01P 7/048 123/41.05
6,349,882 B1 * 2/2002 Kita ..... F01P 7/044 236/34
6,745,727 B1 6/2004 Kramer
6,878,094 B2 * 4/2005 Kitamura ..... F02B 67/06 475/5
7,128,690 B2 * 10/2006 Inoue ..... F16D 27/112 477/175
8,255,115 B2 * 8/2012 Takikawa ..... F01P 7/08 701/36
8,997,472 B2 * 4/2015 Suzuki ..... E02F 9/26 60/328
2001/0029907 A1 * 10/2001 Algrain ..... F01P 3/18 123/41.29
2001/0042849 A1 * 11/2001 Yamamoto ..... F01P 7/044 251/129.04
2002/0050251 A1 * 5/2002 Takahashi ..... F01P 7/048 123/41.1
2002/0166517 A1 * 11/2002 Vogt ..... F01P 7/044 123/41.12
2003/0172883 A1 * 9/2003 Shiozaki ..... F01P 7/042 123/41.12
2004/0011304 A1 * 1/2004 Herynek ..... F01P 7/164 123/41.1
2005/0066914 A1 * 3/2005 Avery ..... F01P 7/048 123/41.12
2005/0124461 A1 * 6/2005 Inoue ..... F16D 27/112 477/179
2006/0060443 A1 * 3/2006 Smith ..... F01P 7/042 192/58.4
2006/0096554 A1 * 5/2006 Shiozaki ..... F01P 7/04 123/41.12
2007/0006824 A1 * 1/2007 Saotome ..... F01P 7/044 123/41.1
2007/0209610 A1 * 9/2007 Bradley ..... F01P 7/165 123/41.29
2008/0034767 A1 * 2/2008 Ziehr ..... B60H 1/00385 62/180
2008/0295785 A1 * 12/2008 Harris ..... F01P 7/165 123/41.08
2009/0107424 A1 * 4/2009 Blassnitz ..... F01P 7/048 123/41.12
2009/0164084 A1 * 6/2009 Hawkins ..... F01P 7/08 701/102
2009/0217655 A1 * 9/2009 Yabuki ..... F01P 7/044 60/456
2009/0277740 A1 * 11/2009 Takikawa ..... F01P 7/08 192/58.61
2010/0064991 A1 * 3/2010 Mizoguchi ..... B60T 5/00 123/41.12
2011/0011076 A1 * 1/2011 Tanaka ..... E02F 9/2228 60/396
2011/0132292 A1 * 6/2011 Schwartz ..... F01P 7/046 123/41.12
2012/0097118 A1 * 4/2012 Malmgren ..... F01P 7/026 123/41.12
2012/0137993 A1 * 6/2012 Kim ..... F01P 7/165 123/41.11
2012/0288377 A1 * 11/2012 Hartman ..... F01P 7/042 417/13
2013/0036991 A1 * 2/2013 Kerns ..... F01P 7/10 123/41.04
2013/0061631 A1 * 3/2013 Katoh ..... F28D 1/0426 62/515
2014/0305159 A1 * 10/2014 Katoh ..... F28D 7/0008 62/515

* cited by examiner

ENGINE COOLING FAN CONTROL STRATEGY

TECHNICAL FIELD

The present disclosure relates generally to engine cooling fans, and more particularly, to a method for controlling an engine cooling fan of a vehicle having a heat engine, such as a truck with an internal combustion engine.

BACKGROUND

Engine cooling fan control systems have been used on various vehicles for thermal management of the engine by turning on the engine cooling fan when the engine needs to be cooled. Cooling is necessary to prevent overheating of the engine under various different speeds and loads. In the case of an internal combustion engine, the amount of heat that needs to be rejected typically requires that the engine have its own cooling system, either air cooled or liquid cooled. While air cooling is adequate for smaller engines, larger engines typically require liquid cooling.

The liquid coolant is circulated through passages in the engine during which heat is absorbed from the engine by conduction. The liquid coolant runs a loop between the engine and a heat exchanger, i.e. a radiator. The heat from the liquid coolant absorbed from the engine is reabsorbed by the radiator.

In situations where the ram air for forcing flow of ambient air through the radiator is not enough for adequate heat rejection, an engine cooling fan associated with the radiator is used to force ambient air through the radiator.

An electro-mechanical device such as a clutch is a type of interface used between the engine and the engine cooling fan. An electrical signal, usually developed via suitable algorithms in the processor of an electric engine control system engages and disengages the clutch to connect and disconnect the cooling fan respectively.

Considerations of fuel economy, noise and temperature control have resulted in various forms of electric control of engine cooling fans. The intent of some electrical control strategies is to selectively connect and disconnect the engine cooling fan according to engine cooling needs. This type of fan control is sometimes called 'On-Off' control. This selective control ensures that the fan is not being used wastefully while attaining adequate cooling.

SUMMARY

Embodiments described herein relate to an engine cooling fan control strategy that includes measuring an engine coolant temperature using an engine coolant temperature sensor connected to the engine, and measuring an engine oil temperature using an engine oil temperature sensor connected to the engine. A first value is selected from a maximum engine coolant temperature threshold calibration curve stored in the processor of the control system based on the engine oil temperature. A second value is selected from a minimum engine coolant temperature threshold calibration curve stored in the processor of the control system based on the engine oil temperature. The engine cooling fan is placed in driven relationship with the engine when the engine coolant temperature exceeds the first value selected from the maximum engine coolant temperature threshold calibration curve. The engine cooling fan is placed in non-driven relationship with the engine when the engine coolant temperature drops below the second value selected from the minimum engine coolant temperature threshold calibration curve.

DETAILED DESCRIPTION

Figure 1:
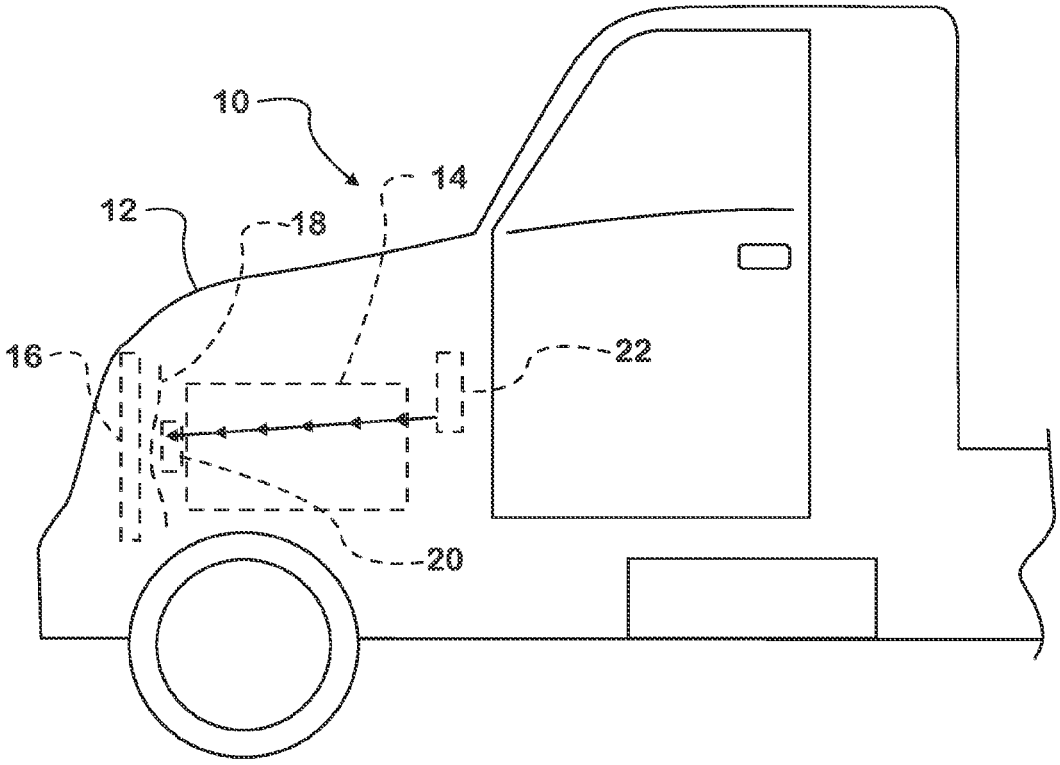
FIG. 1 shows a motor vehicle whose engine comprises an engine cooling fan and engine cooling fan control described herein.

FIG. 1 shows a front portion of a truck 10, having an engine compartment 12 and an engine 14. In the illustrated embodiment, the engine 14 is a diesel engine with a liquid cooling system. However, the engine cooling fan control strategy described herein is not limited to application with a diesel engine and may be used with any appropriate engine. The liquid cooling system includes liquid coolant that circulates through coolant passages in block and heads of the engine 14. The block and heads form engine combustion chambers. A pump may be used to circulate the liquid coolant around the engine 14.

Heat of combustion created in the engine combustion chambers is transferred by conduction to the liquid coolant that is circulating in a loop running between the engine 14 and a radiator 16. The radiator 16, in turn, conductively transfers heat from the circulating liquid coolant to ambient air flowing through the radiator 16. Placement of the radiator 16 at a front of the truck 10 takes advantage of ram air for forcing ambient air through the radiator 16 when truck 10 is in motion.

Since ram air flow may be insufficient under certain conditions for adequate heat transfer between the liquid coolant and the ambient air, an engine cooling fan 18 is associated with the radiator 16 to draw ambient air through the radiator 16. An electric signal processed by a control system 22 of the engine 14 selectively engages and disengages a clutch 20 that provides an interface between engine cooling fan 18 and engine 14. Depending on the signal, the clutch 20 connects and disconnects the engine cooling fan 18 to and from the engine 14 respectively.

The control system 22 is comprised of a processor that processes various types of data related to engine functions including operation of the clutch 20, which in turn controls the engine cooling fan 18. This operation is accomplished by the use of algorithms embodying the engine cooling fan control strategy for the selective operation of the engine cooling fan 18 programmed into the processor.

Figure 2:
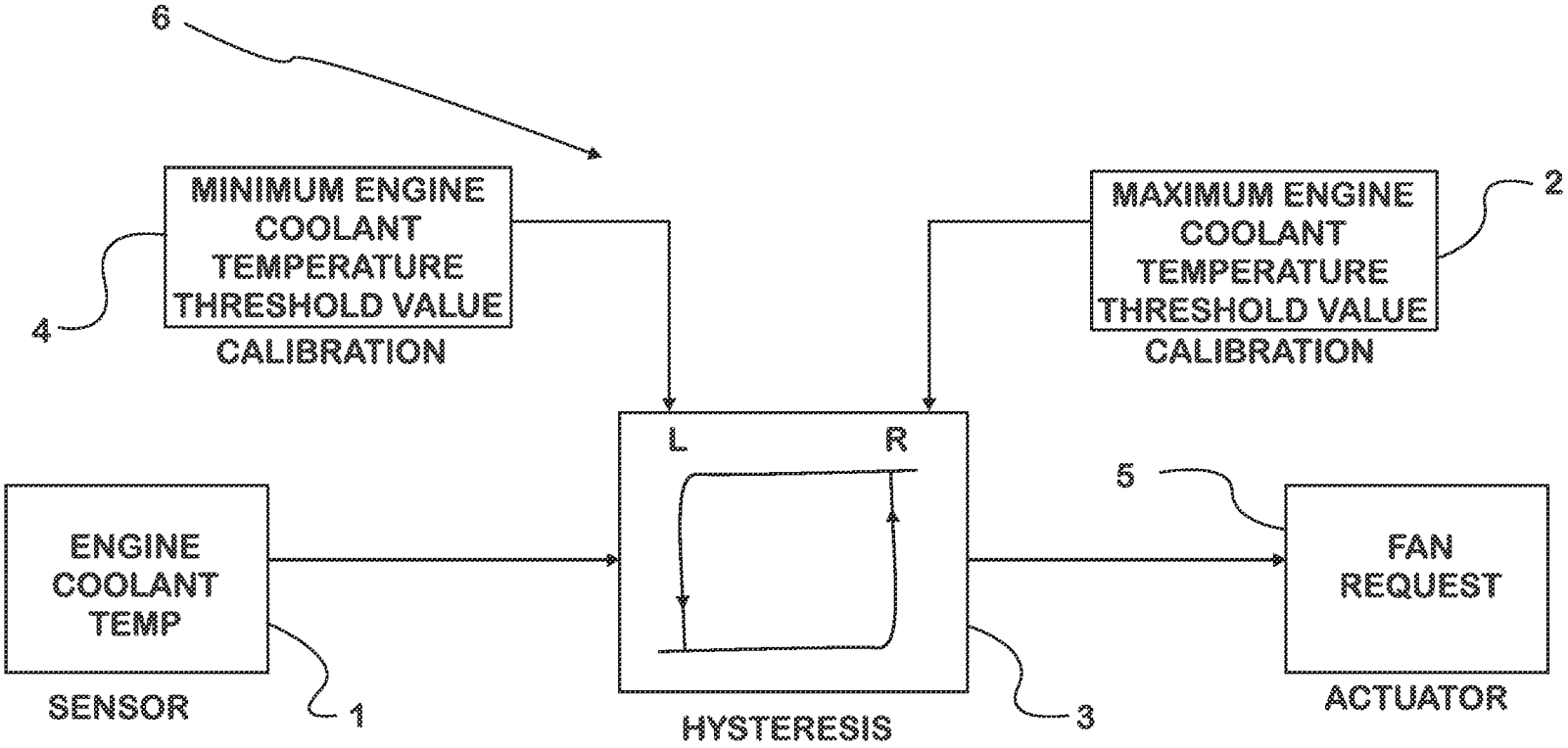
FIG. 2 is a diagram of an embodiment of an engine cooling fan control strategy described herein.

In FIG. 2, a data parameter ECT 1 represents the Engine Coolant Temperature which is measured using an engine coolant temperature sensor usually placed in the cylinder head or the outlet of an EGR cooler. Other locations may be possible. The engine cooling fan control strategy 6 stored in the processor of the control system 22, comprises of a comparison between the actual value of ECT 1 and a calibrated maximum engine coolant temperature threshold value as shown in block 2. When the ECT 1, exceeds the calibrated maximum engine coolant temperature threshold value 2, the engine cooling fan 18 is turned on to bring the engine coolant temperature down to lower than the calibrated maximum engine coolant temperature threshold value 2. A hysteresis function 3 in the engine cooling fan control strategy 6 allows for a range of engine coolant temperature values to ensure that fan requests are not too frequent or unstable, given that the engine coolant temperature, ECT 1 can fluctuate. Once the ECT 1 exceeds the calibrated maximum temperature threshold value, the processor of the engine control system 22 generates an electronic signal to engage the clutch 20 and turn the engine cooling fan 18 on as shown in block 5. The engine cooling fan control strategy 6 further comprises a comparison between the ECT 1 and a pre-calibrated minimum engine coolant temperature threshold value as shown in block 4. Once the ECT 1 drops below the pre-calibrated minimum engine coolant temperature threshold 4 the engine cooling fan 18 can be turned off since the engine coolant temperature, ECT 1 is within acceptable range for cool down of engine components. The engine coolant temperature threshold values are determined through testing and experimentation. The engine coolant temperature, ECT 1 will continue to be maintained within acceptable limits by ram air through the radiator 16 until it exceeds the pre-calibrated maximum temperature threshold value as shown in block 2 and the assistance of the engine cooling fan 18 is needed.

Figure 3:
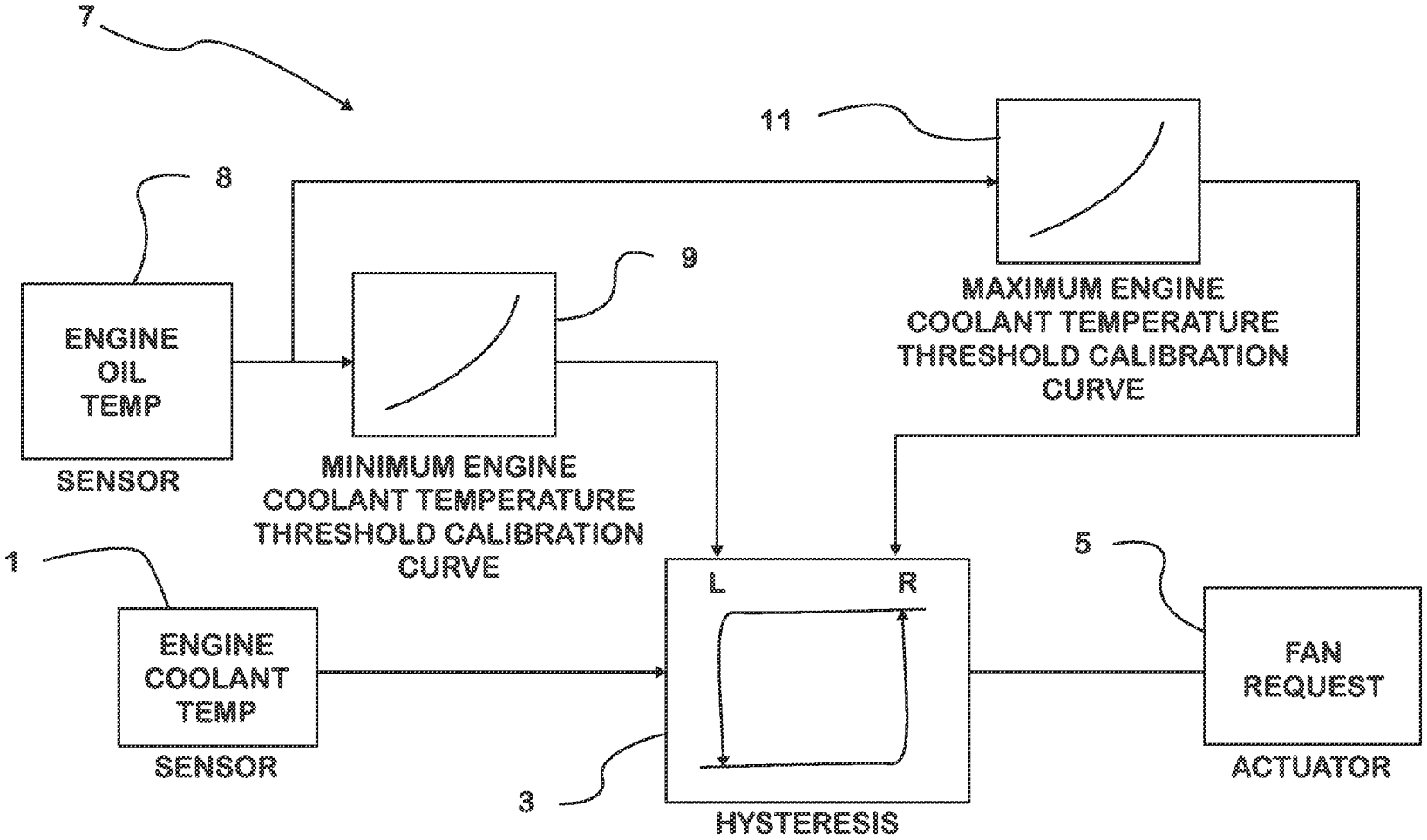
FIG. 3 is a diagram of another embodiment of an engine cooling fan control strategy described herein.

FIG. 3 shows another embodiment of an engine cooling fan control strategy 7. The parameter EOT as shown in block 8 is the engine oil temperature that is measured using an engine oil temperature sensor that may be located in the oil filter header. Other locations may be possible. The EOT 8 is used as an input to a 'Fan On' or maximum engine coolant temperature threshold calibration curve, stored in the processor of the control system 22, as shown in block 11. The maximum engine coolant temperature threshold calibration curve 11 values are determined through appropriate testing and experimentation. Based on the value of the engine oil temperature, EOT 8, input into the maximum engine coolant temperature threshold calibration curve 11, a value of the maximum engine coolant temperature threshold is selected. When the engine oil temperature is within or substantially lower than allowable maximum limits, the maximum engine coolant temperature threshold will be a higher value, so that the engine cooling fan 18 is turned on less frequently and therefore, more efficiently. When the engine oil temperature is higher and nearer to allowable maximum limits, such as during high engine load conditions, the maximum engine coolant temperature threshold will be a lower value selected from the maximum engine coolant temperature threshold calibration curve 11, so that the engine cooling fan 18 turns on more frequently, thus bringing the engine coolant temperature, ECT 1, down, which in turn decreases the engine oil temperature. Similarly, EOT 8 is an input into a minimum engine coolant temperature threshold calibration curve 9, stored in the processor of the control system 22, to determine the minimum engine coolant temperature ECT 1 at which the fan can be turned off. The minimum engine coolant temperature threshold calibration curve 9 values are determined from appropriate data and experimentation. When the engine oil temperature, EOT 8, is higher and nearer to allowable maximum limits, the minimum threshold value of the engine coolant temperature will be a lower value selected from the minimum engine coolant temperature threshold calibration curve 9, so that the fan is turned on for a longer than average period of time. If the engine oil temperature value, EOT 8, is substantially lower than allowable maximum limits, the minimum engine coolant temperature threshold value of the engine coolant temperature will be a higher value along the minimum engine coolant threshold calibration curve 9, so that the engine cooling fan 18 can be turned off earlier than if the engine oil temperature, EOT 8 was higher and nearer to allowable maximum limits. The hysteresis block 3, allows for a range of engine coolant temperature values so that small fluctuations in ECT 1 do not affect engine cooling fan command and function. This logic is an improvement over the logic in FIG. 2 since it takes into consideration the engine oil temperature EOT 8, while controlling the engine coolant temperature ECT 1 through efficient fan usage. Running the engine oil temperature EOT 8 cooler prevents mechanical damage and thereby extends service life of parts.

What is claimed is:

1. An engine cooling fan control strategy of a control system processed by a processor in a motor vehicle powered by an engine having an engine cooling fan coupled to the engine through an interface that is operable to selectively place the engine cooling fan in driven and non-driven relationship with the engine, the engine cooling fan control strategy comprising:

measuring an engine coolant temperature using an engine coolant temperature sensor connected to the engine;

measuring an engine oil temperature using an engine oil temperature sensor connected to the engine;

determining a maximum engine coolant temperature threshold based on the engine oil temperature from a first empirically derived engine oil temperature versus engine coolant temperature calibration curve stored in the processor of the control system;

determining a minimum engine coolant temperature threshold based on the engine oil temperature from a second empirically derived engine oil temperature versus engine coolant temperature calibration curve stored in the processor of the control system, which differs from the first empirically derived engine oil temperature versus engine coolant temperature calibration curve;

placing the engine cooling fan in driven relationship with the engine when the engine coolant temperature exceeds the maximum engine coolant temperature threshold; and placing the engine cooling fan in non-driven relationship with the engine when the engine coolant temperature drops below the minimum engine coolant temperature threshold.

2. The engine cooling fan control strategy of claim 1 wherein the value-of the maximum engine coolant temperature threshold decreases with increase in the engine oil temperature.

3. The engine cooling fan control strategy of claim 1 wherein the value of the minimum engine coolant temperature threshold decreases with increase in the engine oil temperature.

4. The engine cooling fan control strategy of claim 1 wherein the engine coolant temperature is an input to a hysteresis function in the engine cooling fan control strategy.

5. The engine cooling fan control strategy of claim 4 wherein the hysteresis function filters fluctuation in the engine coolant temperature while the engine coolant temperature is approaching at least one of the maximum engine coolant temperature threshold and the minimum engine coolant temperature threshold.

* * * * *